United States Patent [19]

Moss

[11] Patent Number: 4,810,239

[45] Date of Patent: Mar. 7, 1989

[54] FORMS STACKER JAM DETECTOR

[75] Inventor: James R. Moss, Satellite Beach, Fla.

[73] Assignee: Storage Technology Corporation, Louisville, Colo.

[21] Appl. No.: 117,620

[22] Filed: Nov. 5, 1987

[51] Int. Cl.[4] ..... B65H 45/101; B65H 45/109

[52] U.S. Cl. ..... 493/10; 493/15; 493/23; 493/27; 493/30; 493/320; 493/410

[58] Field of Search ..... 493/10, 12, 15, 23, 493/25, 26, 27, 29, 30, 33, 320, 321, 410, 411, 412, 413, 422, 424, 430, 433

[56] References Cited

U.S. PATENT DOCUMENTS 4,213,601 7/1980 Cattorini et al. ..... 493/412
4,227,683 10/1980 Spangler et al. ..... 493/10
4,597,748 7/1986 Wolf ..... 493/29

FOREIGN PATENT DOCUMENTS 177856 10/1983 Japan ..... 493/27

*Primary Examiner*—Frederick R. Schmidt
*Assistant Examiner*—William E. Terrell
*Attorney, Agent, or Firm*—Woodcock Washburn Kurtz Mackiewicz & Norris

[57] ABSTRACT

A forms jam detector for a high-speed line printer having control electronics, a forms guide and a pair of paddlewheel assemblies for fan-folding continuous paper forms fed from the forms guide in a stack within a forms stacker assembly of the printer includes an emitter for projecting a beam of electromagnetic radiation, a receiver coupled to the control electronics and adapted to receive the projected beam, and a member for interposing between the emitter and the receiver. When a jam causes a portion of the paper forms to be forced upwardly from the stack, that portion urges the interposing member upward also to block the projected beam and disable the printer.

18 Claims, 4 Drawing Sheets

FORMS STACKER JAM DETECTOR

BACKGROUND OF THE INVENTION

1. Field of the Invention

This invention relates generally to high-speed line printers, and more particularly to improved methods and apparatus for detecting paper jams in the forms stacker assembly of such printers.

2. Description of the Prior Art

In the impact printing field, a wide variety of printing techniques have been utilized in the past, including the present type of printer, which uses an endless steel character band having letters of the alphabet as well as numerals embossed thereon. The band is conventionally rotated between a drive pulley and an idler pulley. As the band is driven at high speeds adjacent a platen, a selected hammer contained within a bank or banks arranged parallel with respect to the band and platen is actuated to impact with a particularly desired character upon the band, thereby printing the character on forms passing through the print gate. Once printed, the forms are then fed into a stacker assembly which is typically located at the rear of the printer.

Conventional forms stacker assemblies fan-fold the forms such that they are stacked neatly within the stacker bin. It can be readily appreciated, however, that such fan-folding of the forms may lead to various jam conditions which require intervention on the part of the printer operator as well as considerable printer downtime. Controls are provided in typical forms stacker assemblies not only to indicate when the stacker bin is filled but also to hold the forms compacted in place. Furthermore, various sensors are provided which are capable of detecting when jams occur.

For example, in U.S. Pat. No. 4,054,283, issued Oct. 18, 1977 to Rayfield, a count jam circuit is provided. The stacker receives line strobe signals from the printer indicative of the rate at which paper is fed by the printer to the stacker. In such a manner, the line strobe signals control the rate of oscillation of the chute through which paper received by the stacker from the printer passes between two extreme positions. The distance between the two positions defines the oscillation stroke, which is determined by means of a manually-operable selector to be a function of the form length of the paper to be stacked. Paper is then stacked on a pedestal or elevator which is incrementally movable between top and bottom positions. A stack sensor is also provided which senses the top of the stack and causes the pedestal to move toward the bottom position so as to maintain the distance between the chute and the top of the stack relatively constant.

It has also been known in the past to vary the speed of the elevator in accordance both with the speed of the printing and with the thickness of the paper so that the elevator continuously moves at a predetermined speed. Other techniques involve the use of photocells for detecting the position of materials within the stacker bins. However, in U.S. Pat. No. 4,213,601, issued July 22, 1980 to Cattorini et al., and assigned to the assignee of the present invention, simple mechanical sensors are used to generate electrical pulses which operate the elevator in accordance with signals generated by the printer's microprocessor. Exemplary of other mechanical approaches are those printers which utilize a reed or lever to sense misfolded forms.

Another prior art optical system for jam detection is also utilized in the Impact 5000 Series printers manufactured by Documation Incorporated, now StorageTek Printer Corporation, a subsidiary of Storage Technology Corporation. In such printers, a photoemitter and sensor receiver are placed on opposite sides of the stack, and are offset such that a signal transmitted through the photoemitter is interrupted by every other fold in the forms. When a predetermined number of "top of forms" are observed by the printer without the optical sensor's changing state, a stacker jam is flagged. Similar optical sensors are utilized to directly monitor the paper stack in the Model 4248 printers manufactured by the IBM Corporation.

Each of the above described prior art jam detectors suffer from similar disadvantages. For example, the mechanical approaches can easily become entangled with the paper thereby resulting in either damaged forms or printer parts. The optical sensors' performance, on the other hand, has proven in the past to be marginal due to their relative position within the forms path. That is, typical prior art jam detectors having optical sensors position those sensors within the stacker bin. Such positioning of the sensors leads to the discovery of a problem long after jam begins. It would, therefore, be desirable to provide an improved jam detector which does not suffer from the above described disadvantages.

SUMMARY OF THE INVENTION

Accordingly, it is a general object of the present invention to provide improved methods and apparatus for detecting paper jams in the forms stacker assembly of a high-speed line printer. More specifically, it is an object of the present invention to provide methods and apparatus for detecting paper jams in the forms stacker assembly of such printers, wherein such methods and apparatus disable the printer upon detection of the jam in order to cause the printer to stop printing and alert the printer operator of such jams.

Another object of the present invention is to provide methods and apparatus for detecting jams in the forms stacker assembly of high-speed line printers which are adaptable to lightweight paper.

Still another object of the present invention is to provide methods and apparatus for detecting jams in the forms stacker assembly of high-speed line printers which reduce printer downtime.

Briefly, the above objects are accomplished in a high-speed line printer having a forms stacker assembly with powered rollers feeding the forms exiting the printer to a stacker bin by a stacker jam detector which includes a novel photosensor system. The system according to the present invention includes an emitter which sends a beam of light towards a reflective surface, the reflected beam being sensed under normal conditions by a receiver. Means for interposing the beams, thereby indicating an abnormal condition such as misaligned paper or a stacker jam, is positioned within the forms stacker assembly such that the misaligned paper activates the interposing means to thereby disable the printer. In such a manner, printing is quickly stopped, the printer operator is alerted, and damage to the forms or printer parts is minimized.

The above and other objects, advantages, and novel features according to the present invention will become more apparent from the following detailed description of a preferred embodiment when considered in conjunction with the accompanying drawings wherein:

DETAILED DESCRIPTION OF A PREFERRED EMBODIMENT

Figure 1:
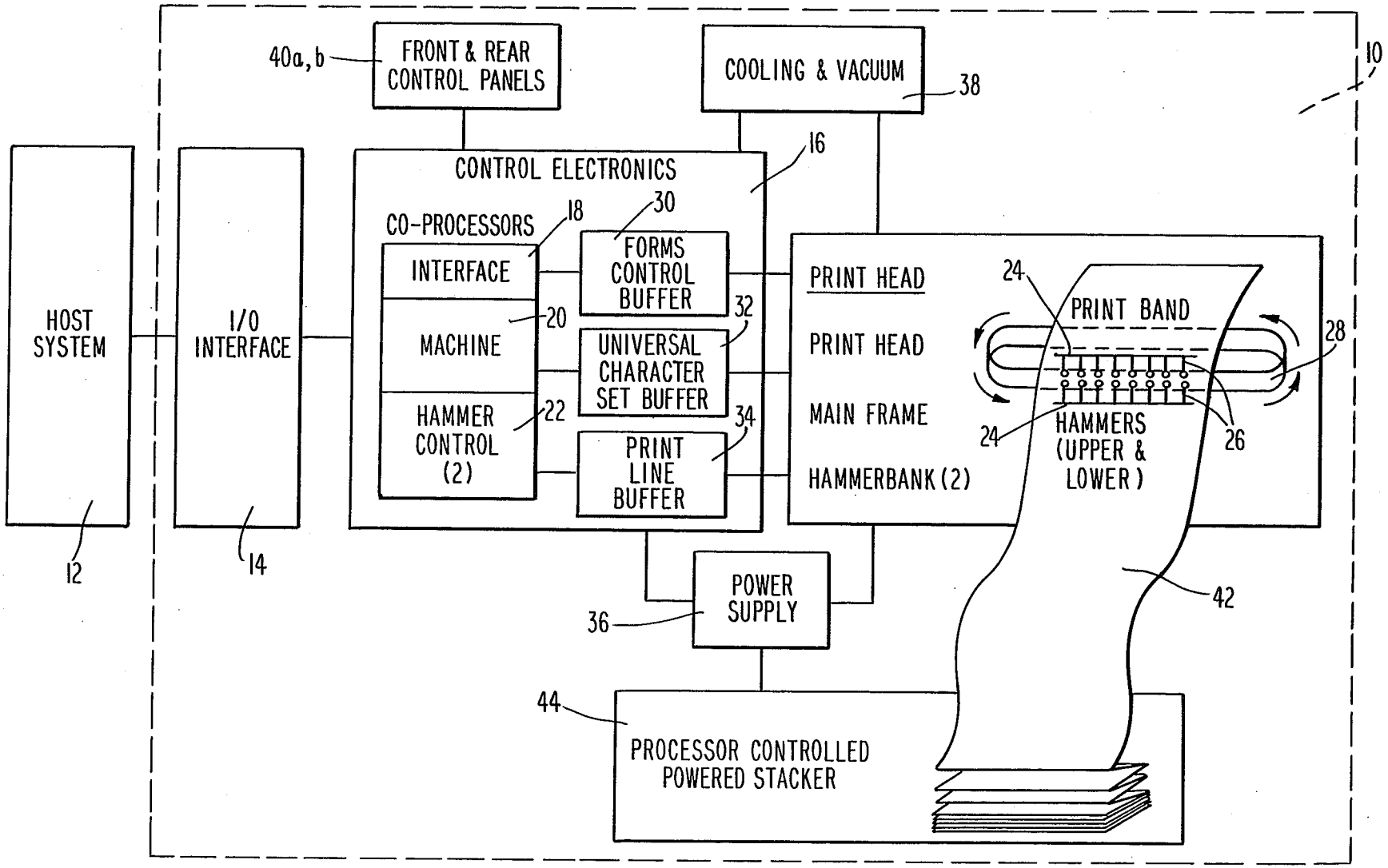
FIG. 1 is a generalized block diagram of a typical high-speed line printer.

Referring now to the drawings, wherein like characters designate like or corresponding parts throughout the several views, there is shown in FIG. 1 a typical high-speed line printer 10, such as the Impact 5000 Series printer, manufactured by Documation Incorporated, now StorageTek Printer Corporation, a subsidiary of Storage Technology Corporation. The printer 10, as is conventional, receives commands and data to be printed from a host system 12 through an input/output (I/0) interface 14. Such commands and data are then processed by control electronics 16 which includes an interface co-processor 18, a machine coprocessor 20, and a hammer control processor 22 for each of the banks 24 of hammers 26 which are arranged parallel to a rotatable (in the direction shown by the arrows) print band 28. The control electronics 16 also includes a forms control buffer (FCB) 30, a universal character set buffer (UCSB) 32, and a print line buffer (PLB) 34.

Power required for the printer 10 is provided by a three-phase power supply 36, while necessary cooling and vacuum is provided by a cooling and vacuum subsystem 38. A printer operator (not shown) may selectively control the printer 10 through front and rear control panels 40*a* and 40*b*. After printing is performed upon the forms 42, the forms 42 are conventionally fed to a processor controlled powered stacker or forms stacker assembly 44. Further details relating to the operation and control of the Impact 5000 Series printers may be found in the following Documation Incorporated manuals, each of which are incorporated herein by reference: "Theory of Operation" —3800014155; "Product Description Manual" —EP-026-0; "Operator's Manual" —3800014171; "Maintenance Manual" —3800014131; "Interface Feature Manual" —3800014159; "Installation Manual" —3800014151; "Illustrated Parts Catalog" —3800014141; and "Schematics" —3800014161.

Figure 2:
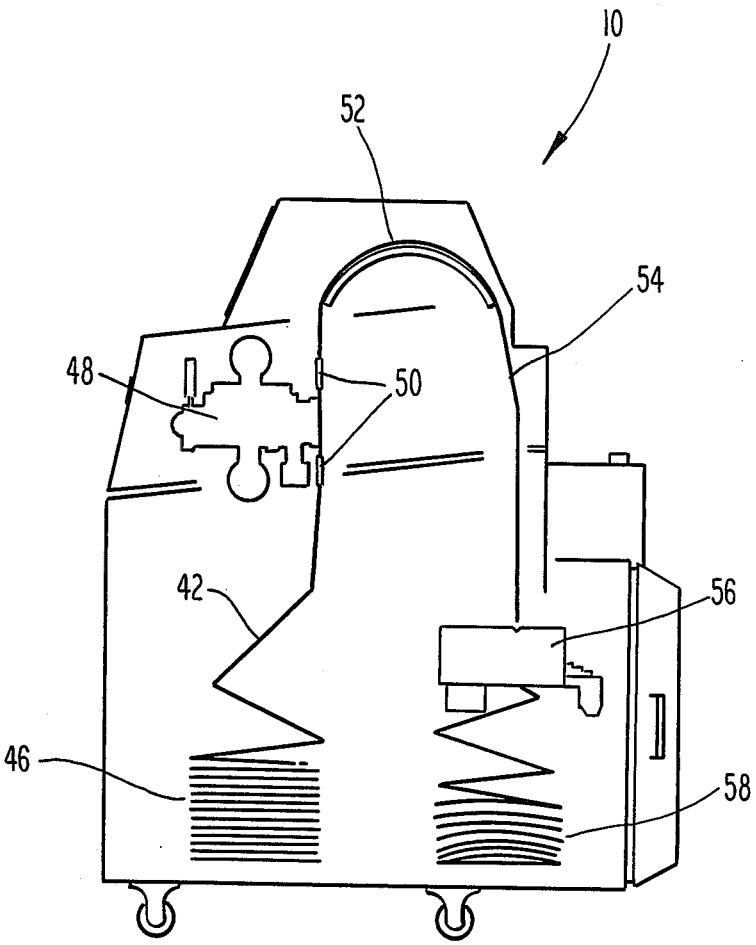
FIG. 2 diagrammatically illustrates the paper forms path in the printer shown in FIG. 1.

An explanation of a typical path through which the paper forms 42 traverse will now be made with reference to FIG. 2. The forms path through the printer 10 starts at a forms loading area 46 below the printgate assembly 48. Thereafter, forms tractors 50 draw the paper forms 42 over a top paper bail 52, down a rear paper bail 54, through a forms guide 56 and into the forms stacker area 58. The forms stacker assembly 44 includes such forms guide 56 and the forms stacker are 58.

Figure 3:
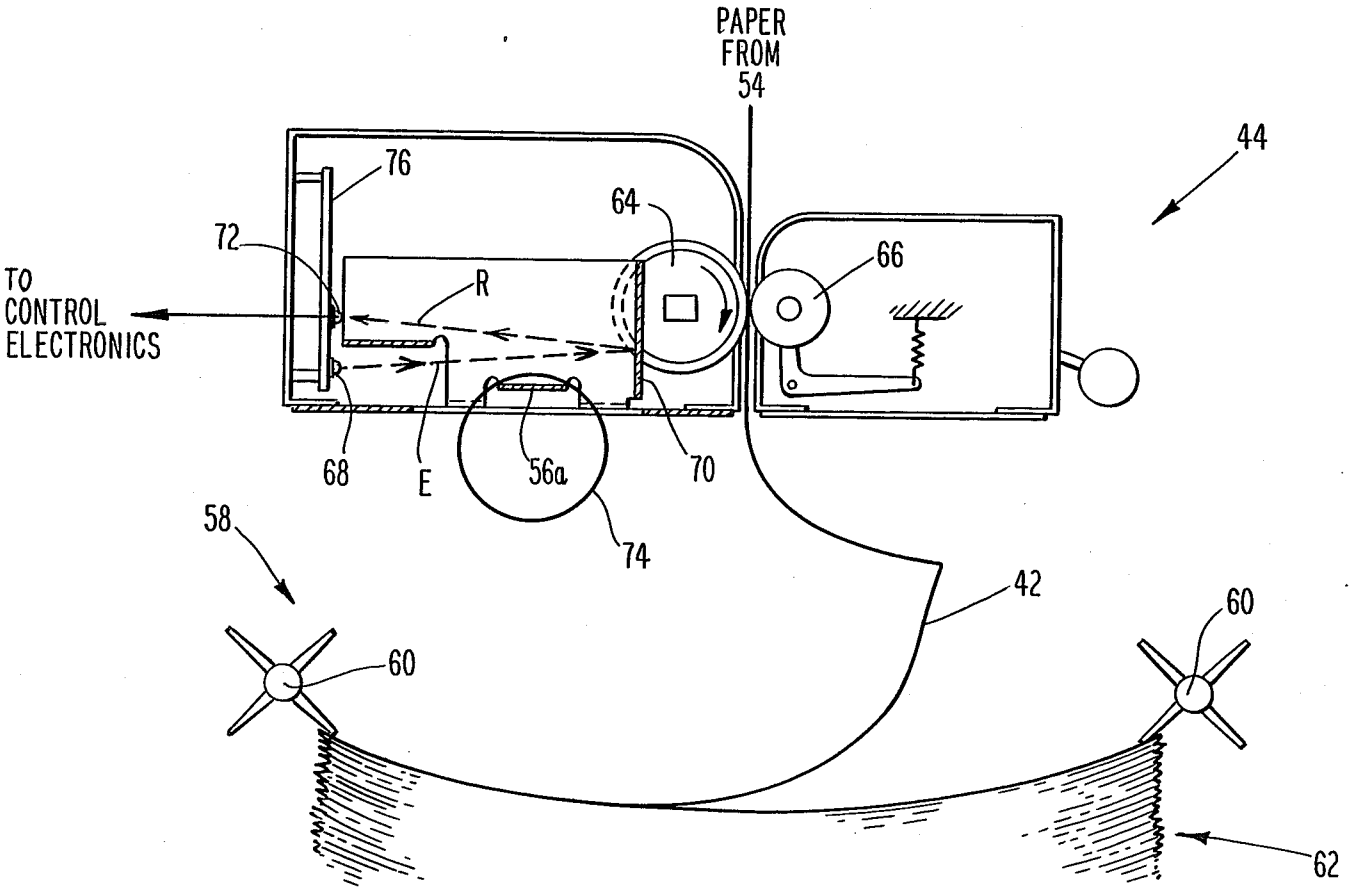
FIG. 3 shows in greater detail the forms stacker assembly illustrated in FIG. 2, including a forms jam detector according to the present invention.
Figure 4:
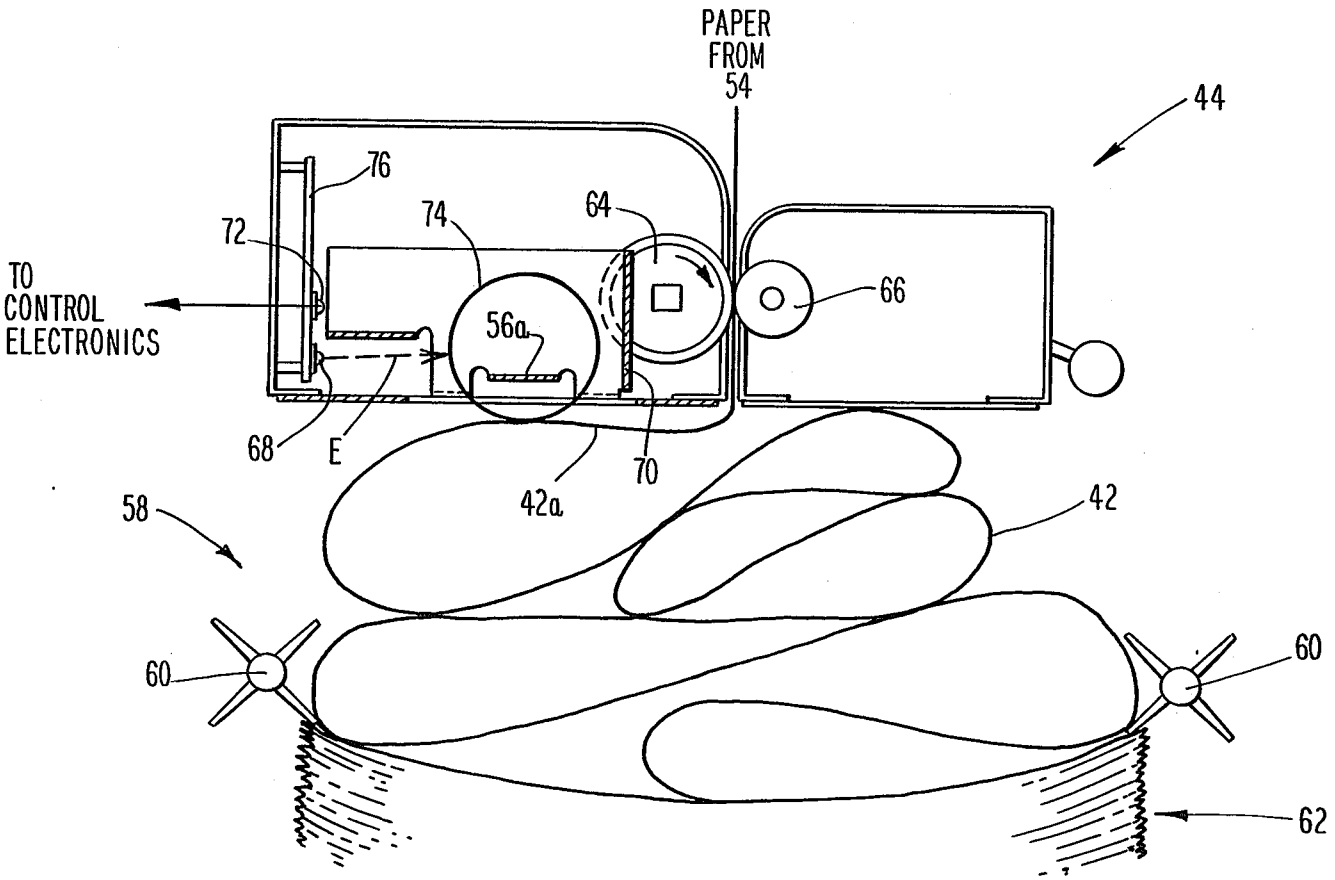
FIG. 4 illustrates a preferred method of detecting jams in the forms stacker assembly shown in FIG. 4.

As shown in greater detail in FIGS. 3 and 4, the forms stacker assembly 44 consists generally of a fixed stack, automatically ascending powered roll unit. Compacting paddlewheels or paddlewheel assemblies 60 assist in maintaining an orderly paper stack 62 as is well known. Operator assistance is required for initial loading, adjusting fold length, setting platform bracket up or down and unloading the forms stacker assembly 44, but other functions may be controlled automatically with the front and rear control panels 40*a* and 40*b* through the control electronics 16 (FIG. 1).

As is conventional, the forms stacker assembly 44 is housed within the rear of the main enclosure of the printer 10 as an integral art of its cabinet. Often times, the forms stacker assembly 44 is enclosed by a clear door (not shown) which minimizes sound transmission from the cabinet. The compacting paddlewheels 60, as well as a conventionally-powered feed roller 64 and idler roller 66 which receive the paper forms 42 exiting from the forms guide 56 (FIG. 2) and forward it to the forms stacker area 58, are enclosed within the forms guide 56 which ascends or descends by automatic control to track with the changing height of the paper stack 62. As is readily apparent from FIG. 3, the paper stack 62 is folded by the paddlewheels 60 in an orderly manner. It should be noted at this juncture that use of the terms "feed roller" and "idler roller" apply equally as well to high-speed line printers which employ a feed roller means and idler roller means comprised of a plurality of such rollers.

If the paper stack 62 is randomly built up due to a misalignment of the paper forms 42 as shown in FIG. 4, the printer 10 may become jammed. Accordingly, a forms jam detector is used to disable the printer 10, alert the printer operator, and prevent damage either to the paper forms 42 or the various components of the printer !0. As shown in FIG. 3, when the paper forms 42 are stacking properly, a light beam E emitted by a conventional photoemitter 68 is reflected by means 70 causing a reflected beam R to be received by a conventional photoreceiver 72. Furthermore, in accordance with one important aspect of the present invention, the forms jam detector includes a means 74 for interposing the emitted light beam E, thereby precluding the reflection of the reflected beam R by the reflective means 70. For whatever reason, when the paper stack 62 randomly builds up as shown in FIG. 4, a portion 42*a* of the paper forms 42 proximate to the forms guide 56 will be forced upward to displace the interposing means 74 upward across the path of the emitted light beam E.

The reflective means 70 preferably comprises a simple planar mirror as shown in FIGS. 3 and 4, but any suitable reflective surface may be utilized in accordance with the present invention so long as it efficiently reflects the emitted light beam E. Alternatively, the use of a reflective means 70 may be eliminated if the photoreceiver 72 is positioned opposite the photoemitter 64, although the preferred arrangement as shown in FIGS. 3 and 4 simplifies the electronics arrangement through the co-location of the photoreceiver 68 and photoemitter 72 on a single logic board 76. The logic board 76, particularly the photoreceiver 72, may thus be conveniently coupled to the control electronics 16 (FIG. 1) such that an output from the forms jam detector according to the present invention will readily disable the printer 10, alert the printer operator through an indication on the front and rear control panels 40*a* and 40*b*, and prevent damage either to the paper forms 42 or the various components of the printer 10.

In the preferred embodiment of the present invention, the interposing means 74 comprises a piece of lightweight, opaque plastic tubing suspended upon a tab portion 56*a* of the forms guide 56. The interposing means 74 is, thus, displaceable upwards to block the path of the emitted light beam E through a minimum amount of force exerted by the portion 42*a* of the paper forms 42. A typical amount of such force is approximately from one to two grams with a conventionally thin paper form 42, although greater or lesser amounts of force may be compensated for through selection of heavier or lighter interposing mean 74.

As is apparent from the foregoing description of the forms jam detector, a method for detecting such jams in the forms stacker assemblies of conventional high-speed line printers may be accomplished in accordance with the present invention by first projecting a beam of electromagnetic radiation, preferably in the form of light, from suitable means. Means for receiving the projected beam are then provided, as well as means for interposing such beam. During normal operations of the forms stacker assembly, the receiving means will receive the projected beam. However, when the forms stacker assembly becomes jammed to cause a misalignment of the paper forms and subsequent upward displacement of the paper forms from their stack, an unstacked portion of the paper forms is utilize to displace the interposing means, block the beam, and diable the printer. Reflective means may also be provided to reflect the projected beam in order to simplify coordination and placement of the projection and receiving means.

Obviously, many modifications and variations of a forms jam detector are possible in light of the above teachings. It is therefore, to be understood that within the scope of the appended claims the present invention may be practiced otherwise than as specifically described herein.

What is claimed is:

1. In a high-speed line printer having a forms stacker assembly including a forms guide with feed roller means and idler roller means, wherein paper forms exiting from the forms guide are fan-folded in a stack below the forms guide, apparatus for detecting jams in the forms stacker assembly comprising:

means for projecting a beam of electromagnetic radiation;

means for receiving said beam; and interposing means for preventing the reception of said beam by said receiving means, said interposing means operable by a movement upward from he stack of a portion of the paper forms.

2. The apparatus according to claim 1, wherein said beam comprises a light beam.

3. The apparatus according to claim 2, wherein said projecting means comprises a photoemitter.

4. The apparatus according to claim 2, wherein said receiving means comprises a photoreceiver.

5. The apparatus according to claim 1, further comprising means for reflecting said beam.

6. The apparatus according to claim 5, wherein said projecting means and said receiving means are colocated upon a common plane.

7. The apparatus according to claim 6, wherein said interposing means is upwardly disposable in a direction between said reflecting means and said common plane.

8. A forms jam detector for a high-speed line printer having a forms stacker assembly which includes a forms guide with feed roller means and idler roller means, and a pair of paddlewheel assemblies below the forms guide for fan-folding continuous paper forms fed through the feed roller means and idler roller means in a stack, wherein the detector comprises:

a photoemitter mounted in the forms guide for projecting a beam of light;

a photoreceiver mounted to receive said beam of light; and interposing means for preventing the reception of said beam of light by said photoreceiver, said interposing means operable by an upward displacement of the fan-folded paper forms from the stack.

9. The detector according to claim 8, wherein said interposing means comprises:

an opaque member having a predetermined weight; and means for suspending said opaque member from the forms guide.

10. The detector according to claim 9, wherein said predetermined weight corresponds substantially to a force exerted by the paper forms during said upward displacement.

11. The detector according to claim 10, wherein said force comprises approximately two grams.

12. The detector according to claim 8, wherein said photoemitter and said photoreceiver are mounted upon a common logic board.

13. The detector according to claim 12, further comprising means for reflecting said beam of light.

14. The detector according to claim 13, wherein said reflecting means comprises a planar mirror disposed opposite said photoemitter and said photoreceiver, said interposing means being disposable upwardly between said planar mirror and said logic board.

15. In a high-speed line printer including a forms stacker assembly with a forms guide for use with continuous paper forms, the printer being adapted to receive commands and data to be printed from a host system as controlled by control electronics, the improvement comprising:

paddlewheel means for fan-folding the paper forms in a stack below the forms guide;

a photoemitter mounted in the forms guide for projecting a beam of light;

means for reflecting said beam of light;

a photoreceiver, operatively coupled to the control electronics, mounted in the forms guide to receive said beam of light reflected by the reflecting means; and means for interposing said beam of light, said interposing means operable by an upward displacement of the paper forms from said stack;

wherein the control electronics is adapted to disable the printer upon the detection of a jam in the forms stacker assembly by said upward displacement.

16. A method of detecting a jam in the forms stacker assembly of a high-speed line printer having a forms guide and means for fan-folding continuous paper forms fed from the forms guide to a stack in the forms stacker assembly, wherein the jam corresponds to an upward displacement of a portion of the paper forms from the stack, the method comprising the steps of:

projecting a beam of electromagnetic radiation from means mounted in the forms guide;

providing means to receive said beam, the reception of which is indicative of a normal stacking operation; and interposing a means to block said beam upon the upward displacement.

17. The method according to claim 16, wherein said beam comprises light.

18. The method according to claim 17, further comprising the steps of:

disposing said projecting means and said receiving means in a common plane; and providing a means for reflecting said beam from said projecting means to said receiving means, said interposing means being displaceable upwardly in a direction between said common plane and said reflecting means.

* * * * *

UNITED STATES PATENT AND TRADEMARK OFFICE

CERTIFICATE OF CORRECTION

PATENT NO. : 4,810,239

DATED : March 7, 1989

INVENTOR(S) : James R. Moss

It is certified that error appears in the above-identified patent and that said Letters Patent is hereby corrected as shown below:

Col. 3, line 62, "are" should be --area--.

Col. 5, line 46, "he" should be --the--.

Signed and Sealed this

Nineteenth Day of September, 1989

*Attest:*

*Attesting Officer*

DONALD J. QUIGG

*Commissioner of Patents and Trademarks*